US006186472B1

(12) United States Patent
Reiter

(10) Patent No.: US 6,186,472 B1
(45) Date of Patent: Feb. 13, 2001

(54) FUEL INJECTION VALVE

(75) Inventor: Ferdinand Reiter, Markgröningen (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/319,635

(22) PCT Filed: Jul. 28, 1998

(86) PCT No.: PCT/DE98/02134

§ 371 Date: Aug. 13, 1999

§ 102(e) Date: Aug. 13, 1999

(87) PCT Pub. No.: WO99/19620

PCT Pub. Date: Apr. 22, 1999

(30) Foreign Application Priority Data

Oct. 10, 1997 (DE) ..... 197 44 739

(51) Int. Cl.[7] ..... F02M 51/00
(52) U.S. Cl. ..... 251/129.21
(58) Field of Search ..... 251/129.21, 129.15; 239/585.1, 585.4, 585.5

(56) References Cited

U.S. PATENT DOCUMENTS 4,944,486 * 7/1990 Babitzka ..... 251/129.21
5,178,362 * 1/1993 Vogt et al. ..... 251/129.21
5,328,102 * 7/1994 Babitzka et al. ..... 239/585.4
5,655,715 * 8/1997 Hans et al. ..... 239/585.1
5,687,468 * 11/1997 Hans et al. ..... 251/129.21
5,769,391 * 6/1998 Noller et al. ..... 251/129.21
5,927,613 * 7/1999 Koyanagi et al. ..... 251/129.21

FOREIGN PATENT DOCUMENTS 195 03 820 8/1996 (DE) .
195 03 821 8/1996 (DE) .
195 37 382 4/1997 (DE) .
197 12 589 6/1998 (DE) .
0 278 099 8/1988 (EP) .

* cited by examiner

*Primary Examiner*—Kevin Shaver
*Assistant Examiner*—Eric Keasel
(74) *Attorney, Agent, or Firm*—Kenyon & Kenyon

(57) ABSTRACT

A fuel injection valve has a metal base body extending over its entire axial length, which includes a core/internal pole and a valve jacket. The internal pole is produced by extrusion and includes a valve inlet connection, the actual core of the electromagnetic circuit, a magnetic choke point and an area for guiding an armature. However, the valve jacket is produced by deep drawing. In addition to its function as a housing part, the valve jacket also serves as a valve seat carrier. A clearance is formed between the valve jacket and the internal pole, holding a magnet coil which is sealed by a ring gasket and is therefore dry.

This fuel injection valve is suitable in particular for use in fuel injection systems of internal combustion engines with spark ignition and gas mixture compression.

33 Claims, 2 Drawing Sheets

FUEL INJECTION VALVE

FIELD OF THE INVENTION

The present invention relates to a fuel injection valve.

BACKGROUND INFORMATION

Unexamined German Patent No. 195 03 821 describes an electromagnetically operated fuel injection valve having a metal base body of the valve designed in one or two parts without a nonmagnetic intermediate part. The base body includes the inlet connection, a magnetic internal pole (core) and a valve seat carrier. In addition, the base body is responsible for guiding an armature which operates a valve closing body that works together with a valve seat. In addition, the base body has a magnetic choke point which has a much smaller wall thickness than the wall thicknesses of the upstream core and the downstream valve seat carrier.

Furthermore, Unexamined German Patent No. 195 37 382 also describes an electromagnetically operated fuel injection valve having an internal core and an external magnet housing. The magnet housing is designed as a stepped housing, forming a coil space between the core and the magnet housing to accommodate a magnet coil. The coil space is sealed with a cover element above the magnet coil and with a nonmagnetic intermediate part below the magnet coil. Thus, two additional parts are needed in addition to the core and the magnet housing to close the magnetic circuit or to prevent a magnet short-circuit.

SUMMARY

The fuel injection valve according to the present invention has the advantage that it can be produced especially easily and inexpensively, although this in no way impairs the valve functions. In an advantageous manner, the internal pole and the valve jacket are shaped so that the valve jacket surrounds the internal pole at least partially radially with a distance, forming a clearance between them into which the magnet coil is inserted. The magnet coil is securely and reliably embedded because it is completely surrounded by the valve jacket in the circumferential direction, and the clearance is bordered axially above and below the magnet coil by metallic contact between the valve jacket and the internal pole. This direct metallic contact between the valve jacket and the internal pole plus the fact that the coil space is thereby closed ensure that no additional intermediate parts are necessary in an inexpensive manner that reduces the number of parts and saves on material. This design permits the best possible selection of materials for manufacturing the internal pole and the valve jacket while retaining the required magnetically soft properties.

In an advantageous manner, the internal pole of the fuel injection valve can be manufactured by extrusion, especially advantageously by cold forming. Steels with a low tensile strength (unalloyed steels) as well as steels with a high tensile strength (high-alloy steels) are suitable for cold extrusion. After cold extrusion, unalloyed steels achieve the strength values (tensile strength, hardness) equivalent to those of alloyed steels after annealing. Because of the magnetic properties of the internal pole, it may be advantageous to subsequently anneal the extruded internal pole blank. It is not necessary to consider the tensile strength, because the required strength values are achieved in any case. A major advantage of extrusion is that it requires less use of material in comparison with known turned parts, which yields definite cost advantages.

It is especially economical if, in addition to the extruded internal pole, a deep-drawn valve jacket is provided and is fixedly joined to the internal pole, forming together with the latter a metal base body which extends over the entire axial length of the valve.

Because of the metallic contact between the valve jacket and the internal pole, it is especially advantageous to provide a magnetic choke point on the internal pole, so that the magnetic circuit is closed around the magnetic choke point over the valve jacket, internal pole and armature. This eliminates the need for nonmagnetic intermediate parts.

The coil space with the magnet coil, which is consequently dry, is sealed by a ring gasket provided between the internal pole and the valve jacket, arranged on the side of the magnet coil axially opposed to the fixed connection of the valve jacket and internal pole.

DETAILED DESCRIPTION

Figure 1:
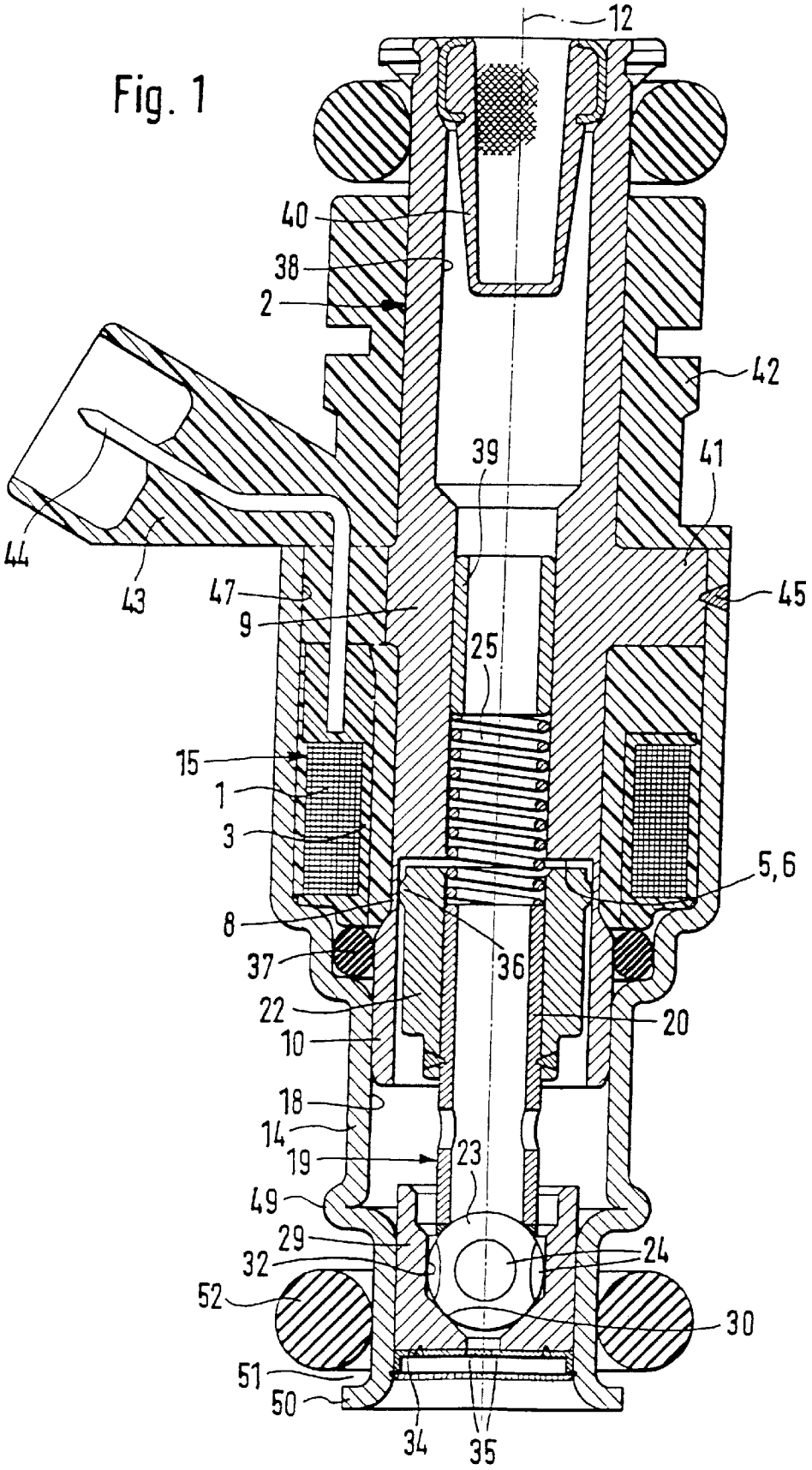
FIG. 1 shows an example embodiment of a fuel injection valve in accordance with the present invention.

The electromagnetically operated valve shown as an example in FIG. 1 in the form of a fuel injection valve for fuel injection systems for internal combustion engines with spark ignition and gas mixture compression has a tubular, extruded core 2 as the internal pole which serves as the fuel inlet connection and is surrounded by a magnet coil 1. A coil form 3 made of plastic accommodates a winding of magnet coil 1. Core 2 has a short taper in its wall thickness in the area of the axial extent of magnet coil 1. Starting from a shoulder 5 of the core, which functions as stop face 6, a thin-walled magnetic choke point 8 follows in the downstream direction. This magnetic choke point 8, which is also tubular but has a much thinner wall than the wall thickness of core 2 upstream and downstream choke point 8, represents the transition of an elongated upper core part 9, forming the inlet connection in particular, to a lower, comparatively short core end 10, as seen in the axial direction.

The wall thickness of thin-walled magnetic choke point 8 amounts to between 0.2 and 0.5 mm, for example, while the wall thickness of the upstream and downstream areas of core 2 should be on the order of 1 to 3.5 mm, for example, to achieve an optimum magnetic flux, i.e., greater by a factor of approximately 5 to 20 than that at choke point 8. The annular cross-sectional areas of core 2 upstream and downstream from choke point 8 are 20 to 30 $mm^2$ large, for example. These sizes are given only to improve an understanding and do not restrict the present invention in any way.

Three sections 9, 8, 10 of core 2 are all designed to be concentric to a longitudinal valve axis 12 at all points. In the area of magnetic choke point 8, metal nonmagnetic intermediate parts are provided with most of the known injection valves in the related art, ensuring a magnetic separation between core 2 and a downstream connecting part that serves as the valve seat carrier but may be omitted with the fuel injection valves according to the present invention.

The core and inlet connection 2 are manufactured by extrusion. In extrusion, the ram and die form a mold gap. The ram presses the material of the workpiece through the mold gap, with the cross section determining the shape. Extrusion of core 2 is performed by cold forming of a suitable steel, for example. Cold extrusion is possible with unalloyed grades of steel with a tensile strength of 350 $N/mm^2$ up to high-alloy steels with a tensile strength of 800 $N/mm^2$. After extrusion of core 2, it is annealed, for example, and the desired contour is produced by machining.

The fuel injection valve also has a thin-walled, tubular valve jacket 14 which is also concentric with longitudinal valve axis 12 and is preferably produced by deep drawing and serves as a housing, as part of the magnetic circuit and as the valve seat carrier, surrounding core 2 at least in sections radially as a part with a larger diameter than core 2. Thus, for example, magnet coil 1 with its coil form 3 is embedded between valve jacket 14 and core 2 in an annular clearance 15 provided for this purpose. A longitudinal orifice 18 runs in valve jacket 14, which is designed with multiple steps, for example, with at least core end 10 projecting into it so that it is in contact with the inside wall of valve jacket 14. Core end 10 serves to transmit the magnetic flux from valve jacket 14 to armature 22 across a radial air gap.

Furthermore, a valve needle 19 which is equipped with a tubular connecting part 20, for example, is arranged in longitudinal orifice 18, with an armature 22 being attached to its upstream end and a spherical valve closing body attached to its downstream end. For example, five flattened areas 24 to allow the fuel to flow past are provided on the periphery of valve closing body 23, which is attached to connecting part 20 by welding, for example.

The fuel injection valve is operated electromagnetically in a conventional manners. The electromagnetic circuit with magnet coil 1, core 2, valve jacket 14 and armature 22 serves to provide the axial movement of valve needle 19 and thus to open the injection valve against the force of a restoring spring 25 or to close the injection valve. Armature 22 is also connected to the end of connecting part 20 facing away from valve closing body 23 by a weld and is aligned with core part 9 or stop face 6 of core 2. In longitudinal orifice 18, a cylindrical valve seat body 29 having a valve seat face 30 is sealingly mounted, e.g., by welding, into the downstream end of valve jacket 14 facing away from core 2.

A guide orifice 32 of valve seat body 29 serves to guide valve closing body 23 during the axial movement of valve needle 19 along longitudinal valve axis 12. On the outer periphery of armature 22, a guide face 36 is provided, for example, which is produced by turning, for example, and also serves to provide axial guidance for valve needle 19, here with respect to core 2 in the area of choke point 8. The minimum of one guide face 36 may be designed, for example, as a continuous circumferential guide ring or as several guide faces arranged on the circumference with a distance between them.

Spherical valve closing body 23 works together with valve seat face 30 of valve seat body 29, tapering in the form of a truncated cone in the direction of flow. On its end face which faces away from valve closing body 23, valve seat body 29 is fixedly connected to a spray hole disk 34, which is designed in a pot shape, for example. Spray hole disk 34 has at least one spray orifice, e.g., four such orifices 35 formed by erosion or punching.

The depth of insertion of valve seat body 29 determines the amount of lift of valve needle 19. The one end position of valve needle 19 when magnet coil 1 is not energized is determined by valve closing body 23 coming in contact with valve seat face 30 of valve seat body 29, while the other end position of valve needle 19 when magnet coil 1 is energized is determined by armature 22 coming in contact with stop face 6 of shoulder 5 of core 2; stop face 6 may be hard chrome plated, for example.

Beneath bobbin 3, a ring gasket 37 designed in the form of an O ring, for example, is arranged in clearance 15 between valve jacket 14 and core 2, thereby sealing the coil space. The annular chamber serving to accommodate ring gasket 37 is delimited by the lower side of bobbin 3, the inside wall of valve jacket 14, with its tapering diameter in the downstream direction, and the outside circumference of core end 10, serving to guide the armature on the inside.

An adjusting sleeve 39, which is made of rolled spring steel plate, for example, and is inserted into a flow bore 38 in core 2 concentric with longitudinal valve axis 12, serves to adjust the spring tension of restoring spring 25 which is in contact with adjusting sleeve 39 and is supported on its opposite end on connecting part 20 of valve needle 19. A fuel filter 40 projects into flow bore 38 in core 2 on its inlet end, ensuring that fuel components which could damage or clog the injection valve due to their size are filtered out.

The core (internal pole, inlet connection) 2 is mostly sealed above a collar 41, which extends radially outward and seals the top of clearance 15 which accommodates magnet coil 1 with a plastic coating 42. This plastic coating 42 includes, for example, an electric cable connector 43 extruded with it, which projects radially outward, for example, directly above collar 41 of core 2 and the upper end of valve jacket 14 facing the inlet end of the injection valve. Cable connector 43 made of plastic includes, for example, two metal contact pins 44, which are directly connected to the winding of magnet coil 1. Contact pins 44 to cable connector 43 project out of coil form 3 through a recess 47 in collar 41. Contact pins 44 in this recess 47 are coated with plastic, because plastic coating 42 extends into clearance 15 between valve jacket 14 and core 2 accommodating magnet coil 1, so that this clearance 15 is also mostly filled with plastic in addition to bobbin 3. Close to cable connector 43, valve jacket 14 is attached to collar 41 of core 2 by several welding spots 45 arranged on the circumference and produced by a laser, for example. This fixed connection need not fulfil a sealing function. However, a continuous peripheral weld 45 may also be provided.

Close to its downstream end, deep-drawn valve jacket 14 has an annular bead 49 formed by folding so that it projects outward, perpendicular to the axial extent of valve jacket 14, running around the circumference, while valve jacket 14 has on its direct downstream end a collar 50 projecting outward in the form of a lap. Annular bead 49 and collar 50 together with the outside wall of valve jacket 14 form a ring groove 51 in this area, with a ring gasket 52 being arranged in it to seal it with respect to a valve receptacle.

Figure 2:
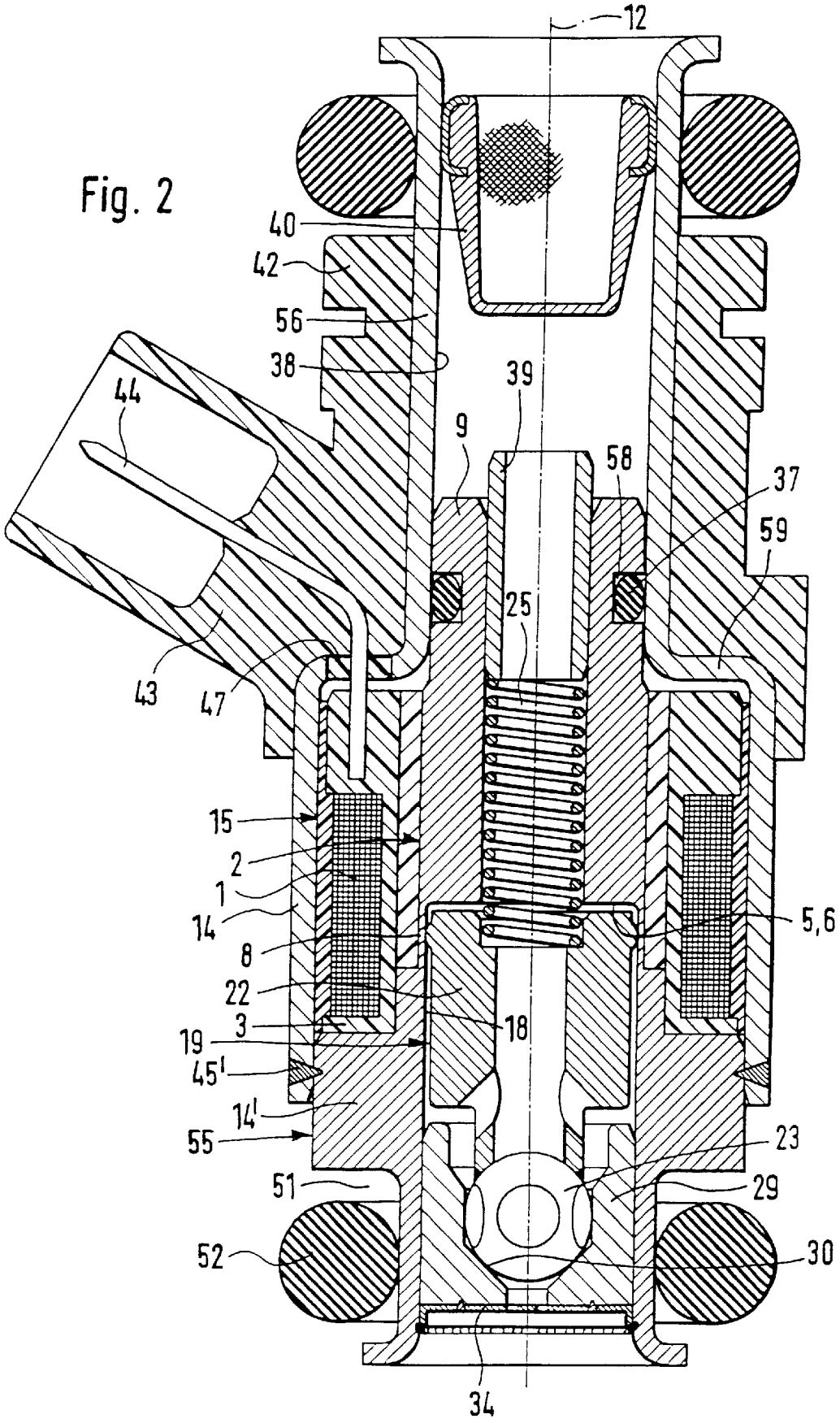
FIG. 2 shows another example embodiment of a fuel injection valve in accordance with present invention.

In the second embodiment shown in FIG. 2, the parts that remain the same or have the same effect as those in the embodiment illustrated in FIG. 2 are labeled with the same reference numbers. The main difference in comparison with the first embodiment is that now a core 2, representing an internal pole, magnetic choke point 8 and a valve tube 55 forming valve seat carrier 14' can be produced by extrusion, while actual valve jacket 14 is designed as a deep-drawn part in one piece with a valve inlet connection 56.

The fuel injection valve according to FIG. 2 also has tubular extruded core 2, which is surrounded by magnet coil 1 but it does not serve as a direct fuel inlet connection, as in the example shown in FIG. 1, but instead is designed in one piece with valve seat carrier 14' downstream, together forming the part designated as valve tube 55. Shoulder 5 of the core, which functions as stop face 6, is followed in the downstream direction by thin-walled magnetic choke point 8. This magnetic choke point 8, which has a much thinner wall than the wall thickness of valve tube 55 upstream and downstream of choke point 8 thus represents the transition from core 2 to valve seat carrier 14' as seen in the axial direction. Close to its downstream end, extruded valve seat carrier 14' has a ring groove 51 which holds a ring gasket 52 for sealing with respect to a valve receptacle.

Concentric with longitudinal valve axis 12, the fuel injection valve has thin-walled, tubular valve jacket 14, which is preferably produced by deep drawing and serves as a housing, as part of the magnetic circuit and as valve inlet connection 56, surrounding valve tube 55 radially at least in sections as a part with a larger diameter than valve tube 55. Thus, magnet coil 1 with its coil form 3 is again embedded between valve jacket 15 and valve tube 55 in an annular clearance 15 provided for that purpose. A flow bore 38, into which at least upper core part 9 projects so that it is in contact with the inside wall of valve inlet connection 56, runs in valve inlet connection 56 of valve jacket 14.

On the other hand, valve tube 55 in turn has a longitudinal inside orifice 18 through which fuel flows. Valve needle 19, which is formed at least by armature 22 and spherical valve closing body 23 attached to its downstream end, is arranged in longitudinal orifice 18. The valve needle is shorter in comparison with the first embodiment, because there is no connecting part 20.

Ring gasket 37 which is needed to seal the coil space to achieve a dry magnet coil 1 and is designed in the form of an O ring, for example, is not arranged in clearance 15 in this embodiment. Nevertheless, ring gasket 37 is between valve jacket 14 and valve tube 55, or more specifically, between valve inlet connection 56 and upper core part 9 of core 2. A peripheral ring groove 58 which serves to accommodate ring gasket 37 is provided on the outer circumference of core 2.

Valve inlet connection 56 as part of valve jacket 14 is mostly covered by plastic coating 42. This plastic coating 42 includes an electric cable connector 43 extruded with it, which projects radially outward directly above a radial shoulder 59 of valve jacket 14, for example. Radial shoulder 59 achieves the result that valve jacket 14 has a larger diameter in the area of extent of magnet coil 1 than in the area of valve inlet connection 56, so that ultimately clearance 15 is created to accommodate magnet coil 1. Cable connector 43 which is made of plastic includes, for example, two metal contact pins 44 which are directly connected to the winding of magnet coil 1. Contact pins 44 to cable connector 43 project out of coil form 3 through recess 47 in radial shoulder 59.

In the area of valve seat carrier 14' below clearance 15, valve jacket 14 is attached to valve tube 55 by, for example, several welding spots 45' produced with a laser around the circumference or by a continuous peripheral weld. This fixed connection need not fulfil any sealing function.

What is claimed is:

1. A fuel injection valve having a longitudinal valve axis, comprising:

a magnet coil;

an integrally formed metal internal pole;

an integrally formed metal valve jacket radially surrounding the metal internal pole, a clearance being formed between the metal valve jacket and the metal internal pole, the magnet coil being inserted in the clearance, the magnet coil being completely surrounded by the metal valve jacket in a peripheral direction, the metal internal pole and the metal valve jacket together delimiting the clearance axially above and below the magnet coil, a first metallic contact being established substantially circumferentially between the metal internal pole and the metal valve jacket above the magnet oil and a second metallic contact being established substantially circumferentially between the metal internal pole and the metal valve jacket below the magnet coil, the metal internal pole and the metal valve jacket being fixedly connected to one another at least in one of the first metallic contact and the second metallic contact;

an armature; and a valve closing body working together with a fixed valve seat face and being operated by the armature;

wherein the magnet coil, the metal internal pole, the metal valve jacket and the armature form an electromagnectic circuit.

2. The fuel injection valve according to claim 1, wherein the metal internal pole is intergrally formed by extrusion.

3. The fuel injection valve according to claim 1, wherein the metal valve jacket is integrally formed by deep-drawing.

4. The fuel injection valve according to claim 1, wherein the metal internal pole is shaped to form a core of the magnetic circuit, a valve inlet connection and an armature guide.

5. The fuel injection valve according to claim 1, wherein the metal internal pole includes a valve tube, the valve tube being shaped to form a core of the magnetic circuit, a valve seat carrier and an armature guide.

6. The fuel injection valve according to claim 1, wherein the metal valve jacket includes a valve seat carrier.

7. The fuel injection valve according to claim 1, wherein the metal valve jacket includes a valve inlet connection.

8. The fuel injection valve according to claim 1, further comprising:

a ring gasket positioned between the metal internal pole and the metal valve jacket and sealing the clearance.

9. The fuel injection valve according to claim 1, wherein the metal internal pole and the metal valve jacket together extend over an entire axial length of the valve.

10. The fuel injection valve according to claim 1, wherein the metal internal pole includes a collar projecting radially outward above the magnet coil, the collar having a recess traversed by contact pins connecting the magnet coil to an electric cable connector.

11. The fuel injection valve according to claim 1, wherein the metal valve jacket includes a radial shoulder above the magnet coil, the radial shoulder having a recess traversed by contact pins connecting the magnet coil to an electric cable connector.

12. The fuel injection valve according to claim 1, wherein the metal internal pole includes a thin-walled magnet choke point, the choke point connected in an upstream direction and in a downstream direction to areas of the metal internal pole having a much greater wall thickness.

13. The fuel injection valve according to claim 12, wherein a wall thickness of the choke point is between about 0.2 mm and 0.5 mm.

14. The fuel injection valve according to claim 12, wherein the choke point is formed in an axial area of extent of the metal internal pole, the area of extent being separated from the metal valve jacket by the clearance.

15. The fuel injection valve according to claim 14, wherein a longitudinal length of the choke point is at least partially surrounded by the magnet coil.

16. The fuel injection valve according to claim 14, wherein a wall thickness of the choke point is between about 0.2 mm and 0.5 mm.

17. The fuel injection valve according to claim 14, wherein the metal internal pole is shaped to form a core of the magnetic circuit, a valve inlet connection and an armature guide.

18. The fuel injection valve according to claim 14, wherein the metal valve jacket includes a valve seat carrier.

19. The fuel injection valve according to claim 14, further comprising:

a ring gasket positioned between the metal internal pole and the metal valve jacket and sealing the clearance.

20. The fuel injection valve according to claim 14, wherein the metal internal pole and the metal valve jacket together extend over an entire axial length of the valve.

21. The fuel injection valve according to claim 14, wherein the metal internal pole includes a collar projecting radially outward above the magnet coil, the collar having a recess traversed by contact pins connecting the magnet coil to an electric cable connector.

22. The fuel injection valve according to claim 14, wherein the metal internal pole includes a valve tube, the valve tube being shaped to form a core of the magnetic circuit, a valve seat carrier and an armature guide.

23. The fuel injection valve according to claim 14, wherein the metal valve jacket includes a valve inlet connection.

24. The fuel injection valve according to claim 14, wherein the metal internal pole and the metal valve jacket together extend over an entire axial length of the valve.

25. The fuel injection valve according to claim 14, wherein the metal valve jacket includes a radial shoulder above the magnet coil, the radial shoulder having a recess traversed by contact pins connecting the magnet coil to an electric cable connector.

26. The fuel injection valve according to claim 14, wherein:

the metal internal pole is shaped to form a core of the magnetic circuit, a valve inlet connection and an armature guide;

the metal valve jacket includes a valve seat carrier;

the metal internal pole and the metal valve jacket together extend over an entire axial length of the valve; and the metal internal pole includes a collar projecting radially outward above the magnet coil, the collar having a recess traversed by contact pins connecting the magnet coil to an electric cable connector.

27. The fuel injection valve according to claim 26, further comprising:

a ring gasket positioned between the metal internal pole and the metal valve jacket and sealing the clearance.

28. The fuel injection valve according to claim 26, wherein a wall thickness of the choke point is between about 0.2 mm and 0.5 mm.

29. The fuel injection valve according to claim 26, wherein the metal internal pole is integrally formed by extrusion and the metal valve jacket is integrally formed by deep-drawing.

30. The fuel injection valve according to claim 14, wherein:

the metal internal pole includes a valve tube, the valve tube being shaped to form a core of the magnetic circuit, a valve seat carrier and an armature guide;

the metal valve jacket includes a valve inlet connection;

the metal internal pole and the metal valve jacket together extend over an entire axial length of the valve; and the metal valve jacket includes a radial shoulder above the magnet coil, the radial shoulder having a recess traversed by contact pins connecting the magnet coil to an electric cable connector.

31. The fuel injection valve according to claim 30, further comprising:

a ring gasket positioned between the metal internal pole and the metal valve jacket and sealing the clearance.

32. The fuel injection valve according to claim 30, wherein a wall thickness of the choke point is between about 0.2 mm and 0.5 mm.

33. The fuel injection valve according to claim 30, wherein the metal internal pole is integrally formed by extrusion and the metal valve jacket is integrally formed by deep-drawing.

* * * * *